US006920919B2

(12) United States Patent
Wilson et al.

(10) Patent No.: US 6,920,919 B2
(45) Date of Patent: Jul. 26, 2005

(54) HEAT EXCHANGER

(75) Inventors: Michael J. Wilson, Racine, WI (US); Gregory G. Hughes, Milwaukee, WI (US); Milisav Lazarevic, Racine, WI (US)

(73) Assignee: Modine Manufacturing Company, Racine, WI (US)

( * ) Notice: Subject to any disclaimer, the term of this patent is extended or adjusted under 35 U.S.C. 154(b) by 139 days.

(21) Appl. No.: 10/395,791

(22) Filed: Mar. 24, 2003

(65) Prior Publication Data

US 2004/0188071 A1 Sep. 30, 2004

(51) Int. Cl.[7] ..... F28D 7/14
(52) U.S. Cl. ..... 165/163; 165/143
(58) Field of Search ..... 165/143, 156, 165/163

(56) References Cited

U.S. PATENT DOCUMENTS

| | | | | |
|---|---|---|---|---|
| 1,777,356 A | * | 10/1930 | Fisher | 165/160 |
| 2,520,755 A | * | 8/1950 | Brown, Jr. | 165/158 |
| 2,820,615 A | | 7/1958 | Peters | |
| 2,844,360 A | * | 7/1958 | Buri | 165/159 |
| 3,253,326 A | | 5/1966 | Henry et al. | |
| 3,976,129 A | | 8/1976 | Silver | |
| 4,304,292 A | * | 12/1981 | Cardone et al. | 165/47 |
| 4,347,894 A | | 9/1982 | Gerlach | |
| 4,858,584 A | | 8/1989 | Bridgeman | |
| 4,872,503 A | | 10/1989 | Marriner | |
| 5,050,670 A | | 9/1991 | Bronnert | |
| 5,213,156 A | | 5/1993 | Eriksson | |
| 5,339,654 A | | 8/1994 | Cook et al. | |
| 5,379,832 A | | 1/1995 | Dempsey | |
| 5,487,423 A | | 1/1996 | Romero | |
| 2001/0037877 A1 | * | 11/2001 | Poloni et al. | 165/133 |

FOREIGN PATENT DOCUMENTS

| | | | | |
|---|---|---|---|---|
| DE | 2351529 A1 | * | 4/1975 | F28D/7/02 |

* cited by examiner

*Primary Examiner*—Allen J. Flanigan
(74) *Attorney, Agent, or Firm*—Wood, Phillips, Katz, Clark & Mortimer

(57) ABSTRACT

An improved heat exchanger includes a first tube (10) of generally circular cross section having a relatively large inside diameter and being U-shaped with opposite ends (12,14) adjacent one another. A second tube having a cross section that is relatively small in relation to the cross section of the first tube (10) and helical shaped section (36) intermediate its ends (32,34) is located within the first tube (10) and extends through caps (44) at the ends (12,14) of the first tube (10) to be received in headers (38,40). The first tube (10) impales headers (26,28) and includes apertures (22,24) aligned with the headers (26,28) and in fluid communication with the interiors thereof.

19 Claims, 2 Drawing Sheets

HEAT EXCHANGER

FIELD OF THE INVENTION

This invention relates to heat exchangers generally, and more particularly, to a heat exchanger that may serve as a water heater and a gas cooler.

BACKGROUND OF THE INVENTION

Ozone layer and/or global warming problems have focused considerable attention on the nature of refrigerants employed in refrigeration systems of various sorts. Some such systems, particularly those that do not have sealed compressor units as are commonly found in vehicular air conditioning systems, are prone to refrigerant leakage. Older refrigerants, HFC 12, for example, are thought to cause depletion of the ozone layer while many of the replacements, HCFC 134*a*, for example, are believed to contribute to the so-called "greenhouse effect" and thus global warming.

As a consequence, a considerable effort is underway to develop refrigeration systems employing transcritical refrigerants such as carbon dioxide. Carbon dioxide is plentiful in the atmosphere and may be obtained therefrom by conventional techniques and employed as a refrigerant in such systems. Should the systems leak the CQ refrigerant, because it was originally obtained from the atmosphere, there is no net increase of the refrigerant in the atmosphere, and thus no increase in environmental damage as a result of the leak.

Transcritical refrigeration systems, such as $CO_2$ systems, operate at relatively high pressures and require, in lieu of a condenser in a conventional vapor compression refrigeration system, a gas cooler for the refrigerant.

The heat rejected by a gas cooler can be employed for various useful purposes and one such use is for heating potable water for residential, commercial, or industrial usages. The present invention is primarily directed at providing a combination water heater and gas cooler.

SUMMARY OF THE INVENTION

It is the principal object of the invention to provide a new and improved heat exchanger. More specifically, it is an object of the invention to provide a new and improved heat exchanger that is particularly suited for use as a gas cooler in a refrigeration system and utilizes the rejected heat from the gas stream being cooled to heat a liquid, such as potable water.

An exemplary embodiment of the invention achieves the foregoing object in a heat exchanger that includes a first tube of generally circular cross section and which has a relatively large internal diameter. The first tube is generally U-shaped with opposite ends adjacent to one another. A second tube having a circular cross section that is relatively small in relation to the relatively large cross section of the first tube is provided and has opposite ends. Intermediate the opposite ends the second tube is a helical configuration having an external diameter about that of the relatively large diameter of the first tube. Convolutions of the helical configuration can be spaced from one another, or could be touching, and the second tube is located within the first tube with the opposed ends of the second tubes extending out of the opposite ends of the first tube. Hollow headers are impaled by the first tube adjacent each of the opposite ends and are sealed thereto and a port in the first tube is adjacent each opposite end and aligned with and in fluid communication with a corresponding one of the headers. A cap is disposed on each of the opposite ends of the first tube and sealed thereto and an aperture in each cap is sized to receive a corresponding one of the opposed ends of the second tube to allow the corresponding one of the opposed ends to extend past the cap. The caps, and each corresponding one of the opposed ends of the second tube are sealed to each other at the corresponding aperture.

In one form, the first tube has opposite ends and at least one U-shaped bend between the opposite ends. In a further form, the first tube has at least two U-shaped bends between the opposite ends.

In a preferred embodiment, the helical configuration of the second tube has an external diameter such that it is in contact with the internal diameter of the first tube.

Preferably, each of the headers is a tube of larger internal diameter than the external diameter of the first tube.

In a preferred embodiment, each of the caps has a flat circular wall surrounded by a peripheral cylindrical flange and sealed to the associate opposite end of the first tube and the aperture is located in the flat circular wall.

In one embodiment of the invention, each of the flanges on the caps abuts and seals against the interior wall of the first tube while in another embodiment, each such flange abuts and seals against the exterior wall of the first tube.

Other objects and advantages will become apparent from the following specification taken in connection with the accompanying drawings.

DESCRIPTION OF THE PREFERRED EMBODIMENTS

The present invention will be described as being useful in the environment of a refrigeration system employing a transcritical refrigerant such as $CO_2$. However, it is to be understood that the heat exchanger may be used in other heat exchange applications that do not involve refrigeration and/or water heating and may find use in refrigeration systems using conventional and/or nontranscritical refrigerants. Accordingly, no limitation to a water heater/gas cooler in a transcritical refrigeration system is intended except insofar as expressly stated in the appended claims.

Figure 1:
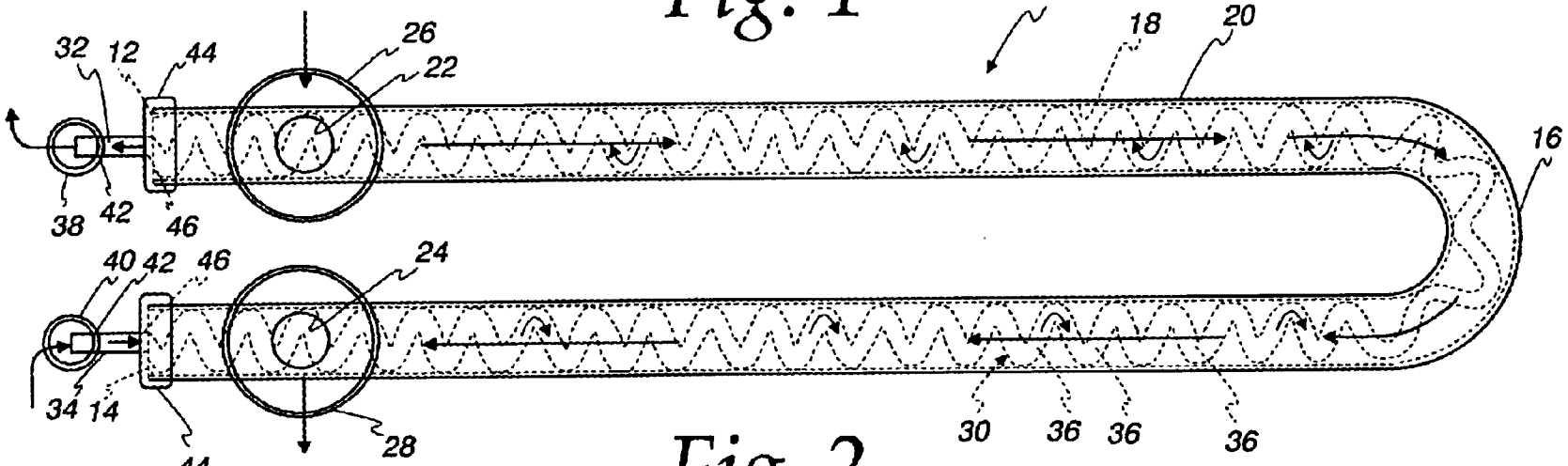
FIG. 1 is a plan view of a heat exchanger made according to the invention.

With the foregoing in mind, the exemplary embodiments of a heat exchanger made according to the invention and particularly suited for use as a gas cooler/water heater will be described. Referring to FIG. 1, an elongated, U-shaped tube, generally designated 10, has opposed ends 12 and 14 which are brought into adjacency with each other as a result of a bent or curved section 16 located approximately midway between the ends 12 and 14 of the tube 10. The tube 10 is generally circular in cross section and, if made without the bend 16, cylindrical in shape. Preferably, the tube 10 will be made of metal such as copper or stainless steel but other materials, including nonmetallic ones, could be used in forming the tube 10 in some instances.

The tube 10 has an interior wall 18 of a relatively large diameter as well as an exterior wall 20.

Adjacent the ends 12 and 14, inlet and outlet apertures 22,24, respectively, are provided in the tube 10. Tubular headers 26 and 28 are impaled by respective ones of the ends 12 and 14 such that they are aligned with the apertures 22,24 and are sealed to the exterior wall 20 of tube 10. It will be observed that the headers 26,28 are preferably tubes of generally circular cross section and of a larger diameter than the outer diameter of the wall 20 of the tube 10.

Figures 3, 4, 5, 6:
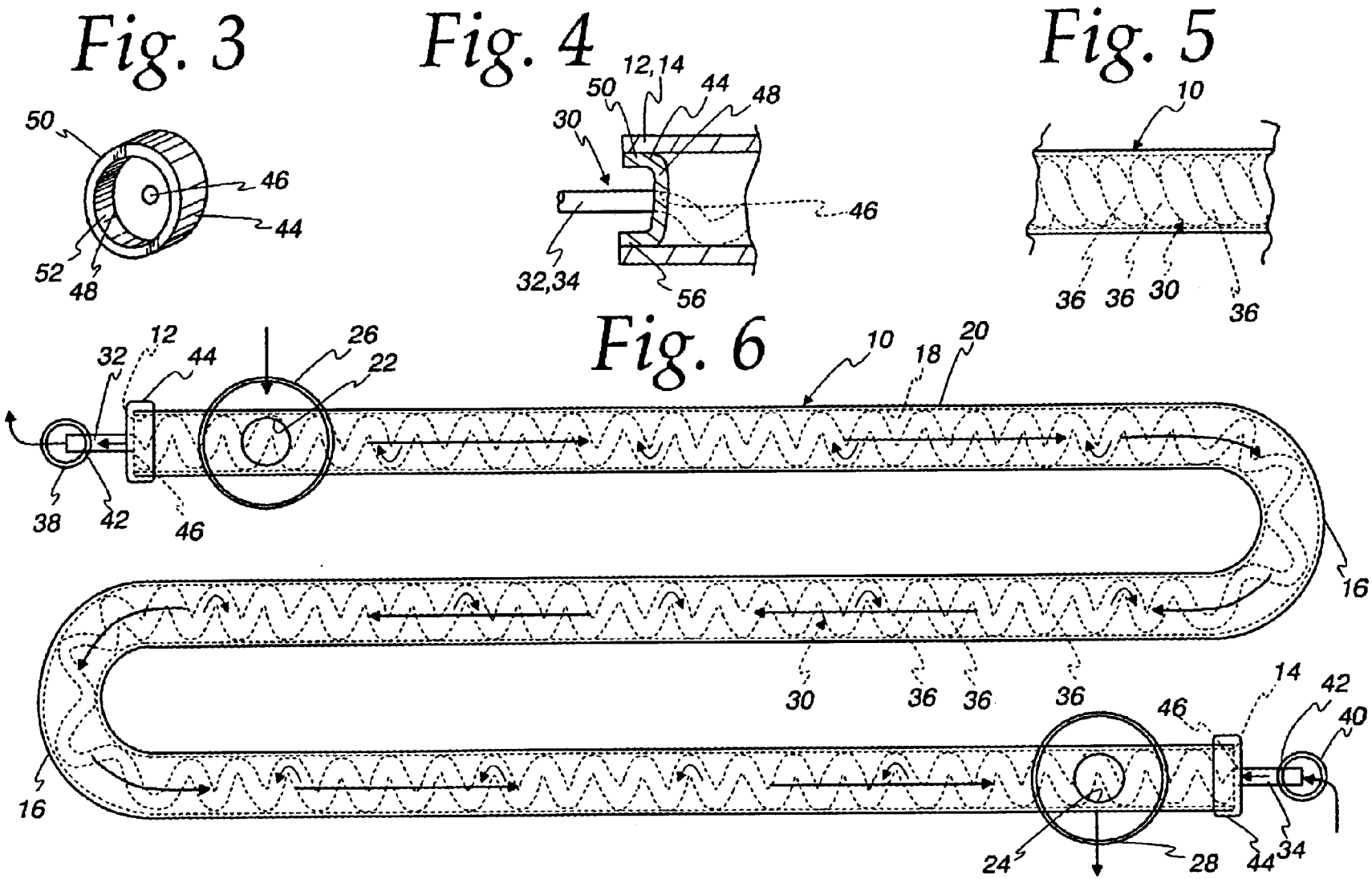
FIG. 3 is a perspective view of a cap employed in the heat exchanger.
FIG. 4 is a fragmentary sectional view of part of the heat exchanger.
FIG. 5 is a fragmentary view showing an optional construction for the heat exchanger of FIG. 1.
FIG. 6 is a somewhat diagrammatic plan view of another embodiment of the heat exchanger made according to the invention.

Contained within the tube 10 is a second tube, generally designated 30, of circular cross section and having a diameter that is relatively small compared to the diameter of the first tube 10. The second tube 30 has opposed ends 32,34 and intermediate its ends, the tube 30 has helical convolutions 36. In some applications it may be advantageous for the convolutions 36 to be spaced from each other as shown in FIG. 1, while in other applications it may be advantageous for the convolutions to be abutted against each other as shown in FIG. 5. In a preferred embodiment, the diameter of the helix forming the convolutions 36 is essentially the same as the inner diameter of the tube 10 so that the convolutions 36 of the tube 30 may be in contact with the inner wall 18 of the tube 10. However, it is not necessary that such be the case and in many instances, the outer diameter of the convolutions 36 could be considerably less than the diameter of the inner wall 18 of the tube 10.

The ends 32,34 of the second tube 30 are relatively straight as can be seen in the left-hand side of FIG. 1 and extend beyond the ends 12,14 of the first tube 10 to terminate within tubular headers 38,40.

To this end, the headers 38 and 40 are apertured as at 42, that is, provided with a circular hole 42 of approximately the same diameter as the outer diameter of the ends 32,34 of the second tube 30. The interfaces of the headers 38,40 and the ends 32,34 at the apertures 42 are sealed.

In the usual case, the second tube 30 will be made of a metal such as copper or stainless steel and will have a wall thickness sufficient, when considering the material of which it is made, to withstand the operating pressures which, in a refrigeration system, particularly a transcritical one, can be substantial. The use of a metal as a material for forming the tube 30 is preferred because its greater thermal conductivity than other materials such as plastics.

Returning to the first tube 10, the same has its ends 12 and 14 capped with caps 44. The caps 44 include a central aperture 46 through which the ends 32,34 of the second tube 30 pass and are sealed.

Figure 2:
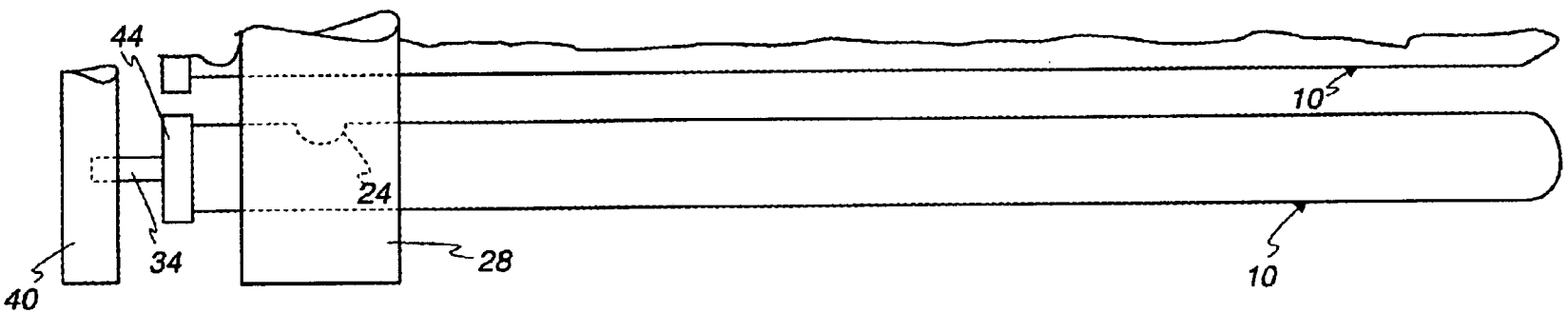
FIG. 2 is a fragmentary, side elevation of the heat exchanger.

A typical cap 44 is shown in perspective in FIG. 3 and it will be seen that the same has a flat, circular base 48 in which the central aperture is located and which is surrounded by a peripheral, cylindrical flange 50. In one embodiment, the caps 44 are adapted to fit onto and seal against the outer surface 20 of the first tube 10. In that case, the inner surface 52 of each cap 54 will have a diameter equal to the outer diameter of the tube 10, that is, the diameter of the outer surface 20 of the wall of the tube 10. This type of arrangement is shown in FIGS. 1 and 2.

In an alternate form of the invention shown in FIG. 4, each cap 44 is again provided with a flat circular central base 48 including the aperture 46 therein through which an end 32,34 of the second tube 30 passes. In this case, the cap 44 is introduced into the end 12,14 of the first tube 10 and the outer surface 56 of the flange 50 will have a diameter that is approximately the same as the diameter of the inner surface 18 of the tube 10 so that the cap 44 and first tube 10 may be sealed to one another.

The various interfaces of the components requiring sealing, including the interface between the caps 44 and ends 12,14, of the first tube 10 and the tube ends 32,34, may be sealed by known bonding techniques. For example, where the components are metal, metallurgical bonds are preferred such as those achieved by soldering, brazing or even welding.

In some instances, it may be desirable to employ more than one of the heat exchangers thus described in a single structure. In this case, the form of the invention fragmentarily illustrated in FIG. 2 may be employed. In this embodiment, two or more of the just described structures are utilized with a single pair of the headers 26,28 and a single pair of the headers 38,40. The number of units employed with a given set of headers will, of course, depend upon the heat exchange capacity desired.

As illustrated, the header 40 serves as an inlet header through the second tube 30 while the header 38 serves as an outlet tube therefore. The header 26 serves as an inlet header for the first tube 10 while the header 28 serves as an outlet header therefore. Thus, flows will be in the direction of arrows illustrated in FIG. 1 and it will be seen that countercurrent flow for maximum efficiency is achieved. However, if desired, the inlet and outlet positions of the headers 38,40 or the headers 26,28 could be reversed to achieve concurrent flow. Baffles, not shown, could be placed in the headers to achieve multipass flow in a conventional fashion if desired.

Advantageously, heat transfer is maximized in the structure by reason of the helical convolutions 36 and the spacing thereof of the second tube 30 within the first tube 10. This configuration promotes turbulence in the fluid entering the header 26 and leaving the header 28 as it passes through the first tube 10. The increased turbulence increases the rate of heat transfer.

By manufacturing the convolutions 36 so that they at least nominally engage the inner surface 18 of the tube 10, the length of the tube 30 within the tube 10 is maximized, thereby maximizing the surface area available for heat transfer and further improve heat transfer efficiency.

The use of caps such as the caps 44, whether in the configuration shown in FIGS. 1 and 2 or in the configuration shown in FIG. 4 provides a simple, but effective way of sealing the ends 12,13 of the first tube 10 as well as the point of entry and exit of the second tube 30 from the first tube 10 with simply an economically manufactured structure, thereby reducing the cost of the heat exchanger.

The apertures such as those shown at 22,24,42,46 as well as the unnumbered apertures in the headers 26,28 through which the first tube 10 passes may be punched, as opposed to machined, thereby lowering the cost of manufacture in this regard as well.

FIG. 6 is diagrammatic representation of an alternate embodiment of a heat exchanger made according to the invention. Other than the exceptions discussed below, all of the components of the embodiment of FIG. 6, and options therefor, are the same as those previously described, with like reference numbers representing like components. The embodiment of FIG. 6 differs from that previously described in that the tube 10 has multiple U-shaped bends 16 rather than the single bend 18 shown in FIG. 1. While the embodiment of FIG. 6 is shown with two U-shaped bends 16, in some applications more than two bends may be desirable or less than two bends may be desirable, depending upon the requirements of the particular application. The use of multiple bends 16 allows for a greater length of the tubes 10 and 30 without increasing the width of the heat exchanger. As seen in FIG. 6, if an even number of bends 16 are provided, the ends 12 and 14 and the ends 32 and 34 are located at opposite sides of the heat exchanger, as are the associated headers 26,28 and headers 38,40, as opposed to being location on the same side of the heat exchanger when an odd number of bends 16 are used as in FIG. 1.

The ability to employ several of the heat exchange structure with a single set of headers provides a great deal of flexibility in designing for a given heat exchange capacity, thereby providing maximum design flexibility.

What is claimed is:

1. A heat exchanger comprising:

a first tube of generally circular cross section and having an internal diameter of relatively large size, said first tube being generally U-shaped with opposite ends adjacent to one another;

a second tube having a circular cross section that is relatively small in relation to said relatively large size and with opposed ends and, intermediate said opposed ends, being in a helical configuration having an external diameter about that of said relatively large size or less;

said second tube helical configuration being located within said first tube with said opposed ends extending out of said opposite ends of said first tube;

hollow headers impaled by said first tube adjacent each said opposite end of said first tube and sealed thereto;

a port in said first tube adjacent each said opposite end and aligned with and in fluid communication with a corresponding one of said headers;

a cap on each of said opposite ends of said first tube and sealed thereto; and an aperture in each said cap sized to receive a corresponding one of said opposed ends of said second tube and to allow the corresponding one of said opposed ends to extend past said cap;

said caps and each said corresponding one of said opposed ends of said second tube being sealed to each other at the corresponding aperture.

2. The heat exchanger of claim 1 wherein said helical configuration external diameter is in contact with said first tube internal diameter.

3. The heat exchanger of claim 2 wherein each of said headers is a tube of larger internal diameter than the external diameter of said first tube.

4. The heat exchanger of claim 1 wherein each of said headers is a tube of larger internal diameter than the external diameter of said first tube.

5. The heat exchanger of claim 1 wherein each said cap has a flat circular wall surrounded by a peripheral cylindrical flange sealed to the associated opposite end of said first tube and said aperture is located in said flat circular wall.

6. The heat exchanger of claim 5 wherein each said flange abuts and seals against the interior wall of said first tube.

7. The heat exchanger of claim 5 wherein each said flange abuts and seals against the exterior wall of said first tube.

8. The heat exchanger of claim 1 wherein convolutions of said helical configuration are spaced from one another.

9. The heat exchanger of claim 1 wherein convolutions of said helical configuration are abutted against each other.

10. A heat exchanger comprising:

a first tube of generally circular cross section and having an internal diameter of relatively large size, said first tube having opposite ends and at least one U-shaped bend between the opposite ends;

a second tube having a circular cross section that is relatively small in relation to said relatively large size and with opposed ends and, intermediate said opposed ends, being in a helical configuration having an external diameter about that of said relatively large size or less;

said second tube helical configuration being located within said first tube with said opposed ends extending out of said opposite ends of said first tube;

hollow headers impaled by said first tube adjacent each said opposite end of said first tube and sealed thereto;

a port in said first tube adjacent each said opposite end and aligned with and in fluid communication with a corresponding one of said headers;

a cap on each of said opposite ends of said first tube and sealed thereto; and an aperture in each said cap sized to receive a corresponding one of said opposed ends of said second tube and to allow the corresponding one of said opposed ends to extend past said cap;

said caps and each said corresponding one of said opposed ends of said second tube being sealed to each other at the corresponding aperture.

11. The heat exchanger of claim 10 wherein said helical configuration external diameter is in contact with said first tube internal diameter.

12. The heat exchanger of claim 11 wherein each of said headers is a tube of larger internal diameter than the external diameter of said first tube.

13. The heat exchanger of claim 10 wherein each of said headers is a tube of larger internal diameter than the external diameter of said first tube.

14. The heat exchanger of claim 10 wherein each said cap has a flat circular wall surrounded by a peripheral cylindrical flange sealed to the associated opposite end of said first tube and said aperture is located in said flat circular wall.

15. The heat exchanger of claim 14 wherein each said flange abuts and seals against the interior wall of said first tube.

16. The heat exchanger of claim 14 wherein each said flange abuts and seals against the exterior wall of said first tube.

17. The heat exchanger of claim 10 wherein convolutions of said helical configuration are spaced from one another.

18. The heat exchanger of claim 10 wherein convolutions of said helical configuration are abutted against each other.

19. The heat exchanger of claim 10 wherein said first tube has at least two U-shaped bends between the opposite ends.

* * * * *